US009954292B2

(12) United States Patent
Matsui et al.

(10) Patent No.: US 9,954,292 B2
(45) Date of Patent: Apr. 24, 2018

(54) TERMINAL FITTING

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Masaaki Tabata, Mie (JP); Yasuo Omori, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/520,097

(22) PCT Filed: Nov. 6, 2015

(86) PCT No.: PCT/JP2015/081266

§ 371 (c)(1),
(2) Date: Apr. 19, 2017

(87) PCT Pub. No.: WO2016/076212

PCT Pub. Date: May 19, 2016

(65) Prior Publication Data

US 2017/0310026 A1 Oct. 26, 2017

(30) Foreign Application Priority Data

Nov. 10, 2014 (JP) ..... 2014-227774

(51) Int. Cl.
*H01R 11/12* (2006.01)
*H01R 4/18* (2006.01)

(52) U.S. Cl.
CPC ..... *H01R 11/12* (2013.01); *H01R 4/18* (2013.01)

(58) Field of Classification Search
CPC ..... H01R 13/28; H01R 13/111; H01R 23/27
(Continued)

(56) References Cited

U.S. PATENT DOCUMENTS 2,522,417 A * 9/1950 West ..... H01R 13/28 439/286
3,092,430 A 6/1963 Miller
(Continued)

FOREIGN PATENT DOCUMENTS

JP 49-54090 5/1974
JP 3314846 6/2002

OTHER PUBLICATIONS

International Search Report dated Dec. 8, 2015.

*Primary Examiner* — Tulsidas C Patel
*Assistant Examiner* — Marcus Harcum
(74) *Attorney, Agent, or Firm* — Gerald E. Hespos; Michael J. Porco; Matthew T. Hespos

(57) ABSTRACT

A terminal fitting (T) connects a plurality of wires (40) by a plurality of terminal fittings being connected to end parts of the wires (40) and held in contact, and includes a wire connecting portion (10) to be connected to the end part of the wire (40), a tubular portion (11) having a tubular shape and a shaft (12) fittable inside the tubular portion (11). The terminal fittings are held in contact by fitting the tubular portion (12) and the shaft (12) together. The tubular portion (11) or the shaft (12) is provided with an arcuate portion configured to enable the rotation of each of the tubular portion and the shaft-shaped portion about an axis in a state where the tubular portion and the shaft-shaped portion are fit together.

2 Claims, 23 Drawing Sheets

(58) Field of Classification Search
USPC ..... 439/284, 286, 287, 290, 291
See application file for complete search history.

(56) References Cited

U.S. PATENT DOCUMENTS

| | | | | |
|---|---|---|---|---|
| 3,169,814 | A * | 2/1965 | Collins | H01R 13/28 439/290 |
| 5,108,304 | A * | 4/1992 | Bogiel | H01R 13/28 439/287 |
| 7,794,257 | B2 | 9/2010 | Rozet et al. | |
| 2010/0197179 | A1* | 8/2010 | Miyamoto | H01R 4/646 439/877 |
| 2016/0134048 | A1* | 5/2016 | Kato | H01R 13/625 439/587 |

* cited by examiner

TERMINAL FITTING

BACKGROUND

1. Field of the Invention

The invention relates to a terminal fitting.

2. Description of the Related Art

Known terminal fittings connect a plurality of wires by connecting a plurality of terminal fittings to end parts of the wires and holding the terminal fittings in contact. For example, Japanese Patent No. 3314846 discloses connecting terminal fittings to end parts of wires. The terminal fittings then are held in contact by being inserted into terminal accommodation chambers of a housing. The terminal accommodation chambers are provided side by side in a vertical direction in the housing, and a resilient contact piece provided on an upper surface side of the terminal fitting contacts a connecting protrusion provided on a lower surface side of the terminal fitting inserted into the adjacent terminal accommodation chamber in an upper stage. However, in the configuration described in Japanese Patent No. 3314846 an arrangement shape of the terminal fittings is fixed, and it was not possible to flexibly change the arrangement shape, for example, in accordance with a wiring space.

The invention was completed based on the above situation and aims to provide a terminal fitting capable of flexibly changing an arrangement shape of a plurality of terminal fittings.

SUMMARY

The invention is directed to a terminal fitting for connecting a plurality of wires by a plurality of terminal fittings being connected to end parts of the wires and held in contact with one another. The terminal fitting includes a wire connecting portion to be connected to the end part of the wire, a tubular portion having a tubular shape, and a shaft fittable inside the tubular portion. The terminal fittings are held in contact by fitting the tubular portion and the shaft to each other. The tubular portion and/or the shaft has an arcuate portion configured to enable rotation of each of the tubular portion and the shaft about an axis in a state where the tubular portion and the shaft are fit to each other.

The tubular portion and the shaft may be fittable to each other with axial orientations changed. According to this configuration, a wiring direction of the wires can be selected by fitting the tubular portion and the shaft to each other with the orientations of the terminal fittings changed.

The tubular portion and the shaft may be provided side by side in a direction substantially perpendicular to an axial direction. According to this configuration, the positions of the terminal fittings can be aligned in the axial direction.

The tubular portion and the shaft may be displaced in an axial direction. According to this configuration, the terminal fittings may be displaced little by little in the axial direction if the shafts and the tubular portions are fit to each other. Thus, the terminal fittings can be wound spirally and, hence, a radius in a front view can be reduced.

According to the invention, an arrangement shape of the terminal fittings can be flexibly changed since each of the terminal fittings held in contact can rotate about an axis in a fitting part.

DETAILED DESCRIPTION

Hereinafter, a first embodiment of the invention is described in detail with reference to FIGS. 1 to 12.

Figure 1:
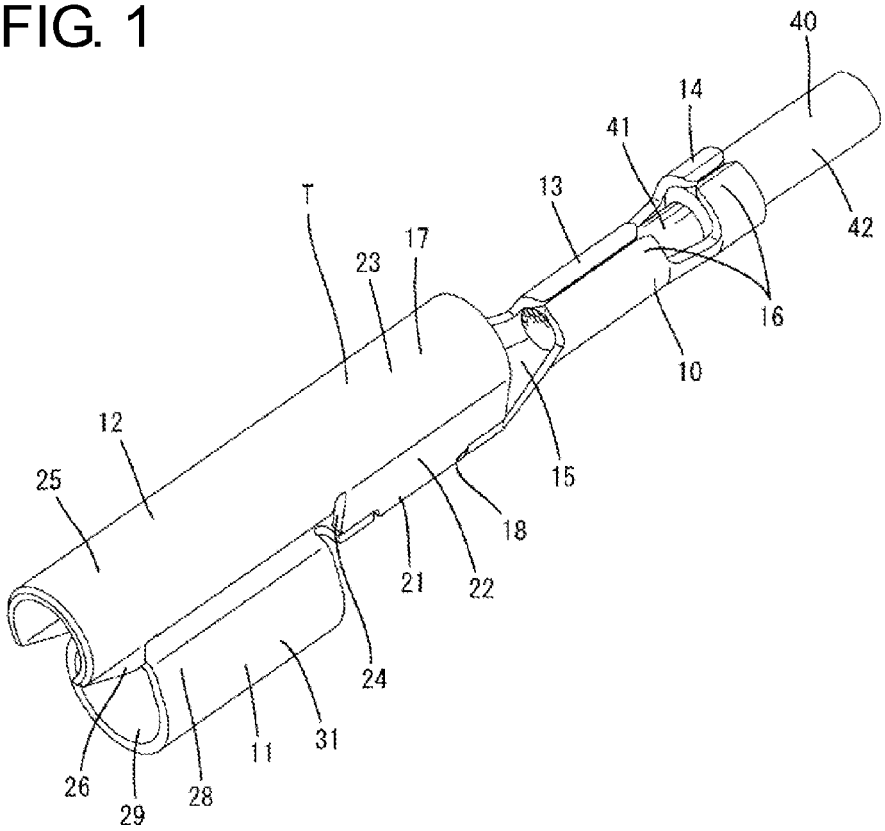
FIG. 1 is a perspective view showing a terminal fitting in a first embodiment in a state connected to an end part of a wire.

A terminal fitting T in this embodiment is for splicing and connecting a plurality of wires 40 by a plurality of terminal fittings T being connected to end parts of the wires 40 and held in contact. Each terminal fitting T integrally includes a wire connecting portion 10 to be connected to the end part of the wire 40, a tubular portion 11 having a tubular shape and a shaft 12 fittable inside the tubular portion 11. The terminal fittings T are held in contact by fitting the tubular portions 11 and the shafts 12 to each other. In the following description, a left-lower side and a right-upper side (side to be connected to the wire 40) in FIG. 1 are referred to as a front and a rear and an upper side (side to be crimped to the wire 40) and a lower side in FIG. 1 are referred to as an upper side and a lower side.

The terminal fitting T includes a long and narrow bottom wall 15 extending in a front-rear direction, and the wire connecting portion 10 is provided on a rear end part of the bottom wall 15. The wire connecting portion 10 includes a wire barrel 13 to be crimped to a core 41 exposed at the end part of the wire 40 and an insulation barrel 14 to be crimped to an end part of an insulation coating 42. Both the wire barrel 13 and the insulation barrel 14 include crimping pieces 16 standing up from the bottom wall 15, and the crimping pieces 16 are crimped to enclose each of the core 41 and the insulation coating 42.

The tubular portion 11 and the shaft 12 are provided at a front end part of the terminal fitting T. The tubular portion 11 and the shaft 12 are provided side by side in a direction substantially perpendicular to an axial direction with the shaft 12 formed on an upper side and the tubular portion 11 formed on a lower side across the bottom wall 15.

The shaft 12 extends forward from a base 17 that stands on the upper surface of the bottom wall 15 at an intermediate part in the front-rear direction. The base 17 is formed into a tubular shape on the upper surface of the bottom wall 15. The base 17 is bent up from one of the left and right side edges of the bottom wall 15 and reaches the other edge, thereby being closed over the entire periphery. A projecting step 21 is formed on an end edge of the base 17 and is to be fit into a recess 18 formed by recessing the side edge of the bottom wall 15 (see FIGS. 3 and 5).

Figure 2:
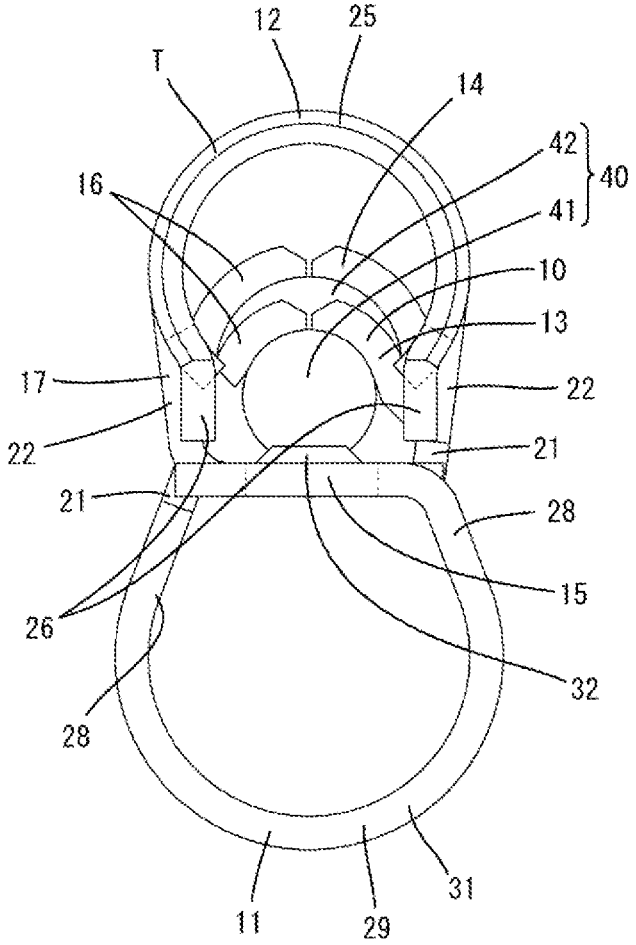
FIG. 2 is a front view showing the terminal fitting in the state connected to the end part of the wire.
Figure 3:
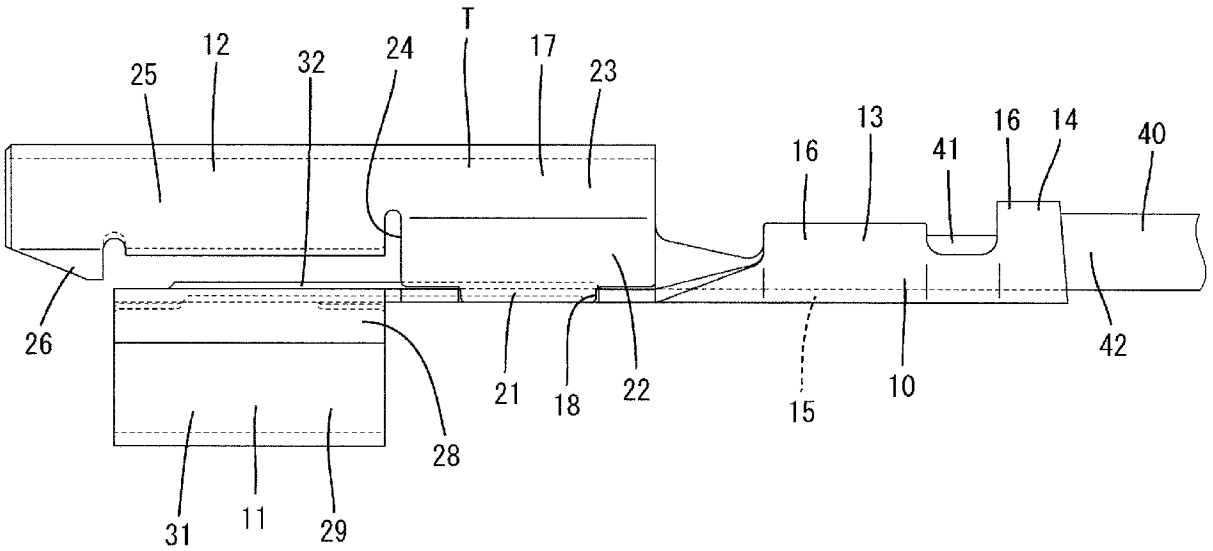
FIG. 3 is a side view showing the terminal fitting in the state connected to the end part of the wire.
Figure 4:
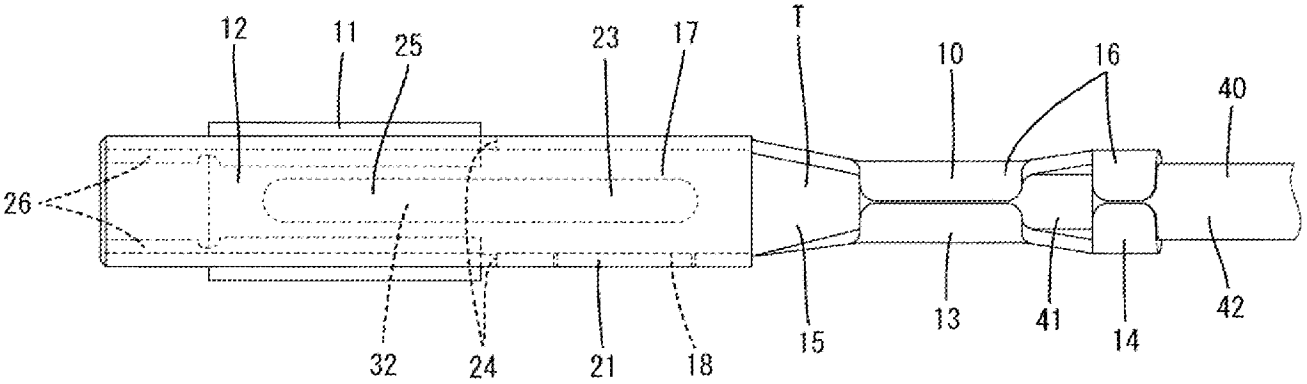
FIG. 4 is a plan view showing the terminal fitting in the state connected to the end part of the wire.
Figure 5:
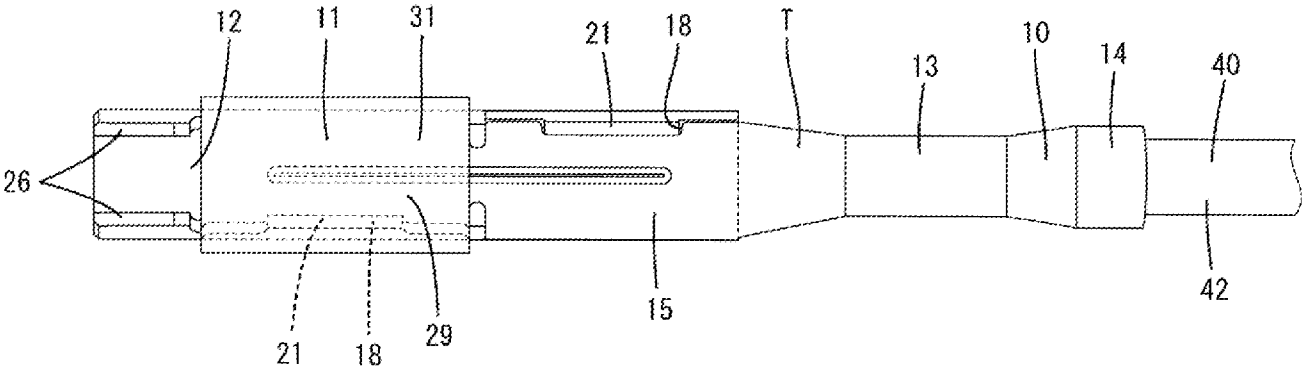
FIG. 5 is a bottom view showing the terminal fitting in the state connected to the end part of the wire.

As shown in FIG. 2, the base 17 includes a pair of upper side walls 22 inclined slightly out toward an upper side from both side edges of the bottom wall 15 and an upper arcuate wall 23 connected to the upper ends of the upper side walls 22.

As shown in FIG. 1, the shaft 12 is continuous with a front side of the base 17. An upper part of the shaft 12 has substantially the same cross-sectional shape as the upper wall 23 of the base 17. Further, a lower part of the shaft 12 is separated from the base 17 via a slit 24 and is formed into an arcuate shape continuous with the upper part. As shown in FIG. 2, the shaft 12 is open down by having a lower end portion cut off, and is arranged while being separated upwardly from the bottom wall 15. The shaft 12 has a shaft-side arcuate portion 25 forming one arcuate shape having a substantially equal radius substantially in entirety.

Figure 8:
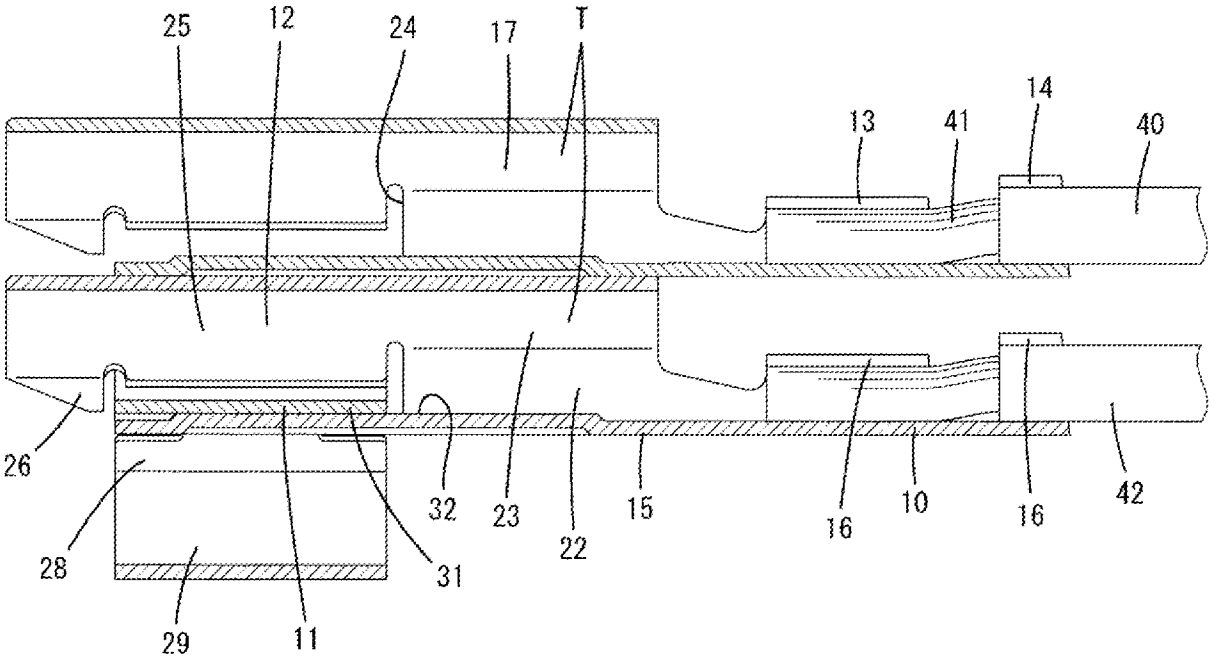
FIG. 8 is a section showing the terminal fittings in the state where the shaft and the tubular portion are fit to each other.
Figure 9:
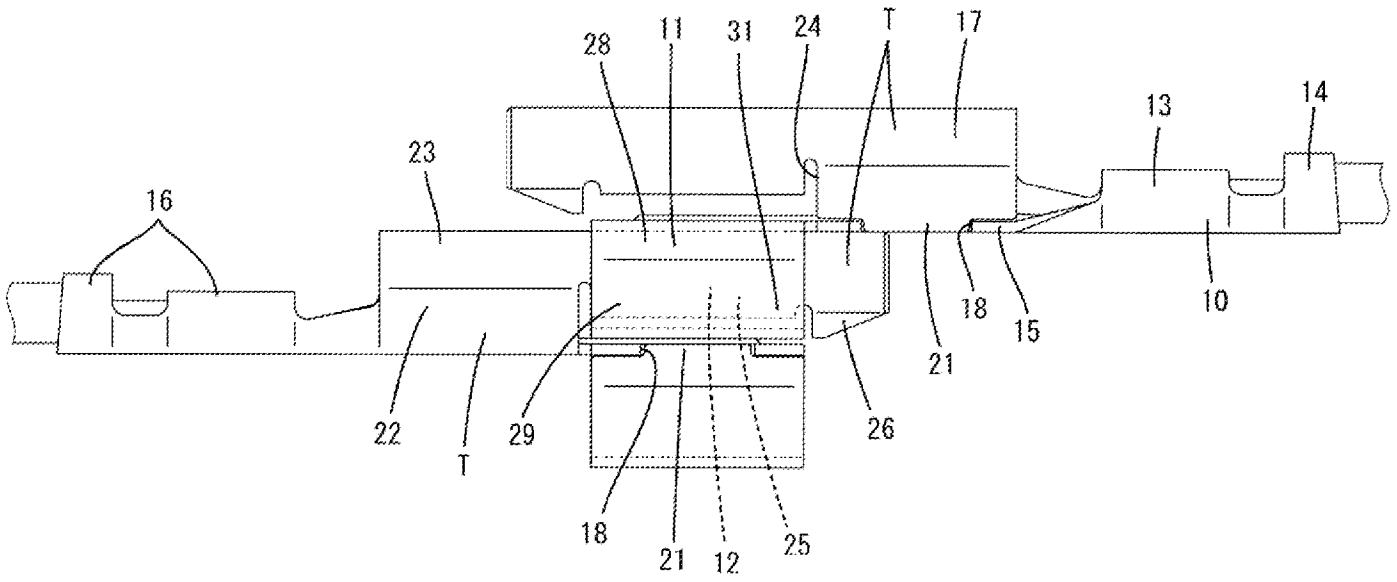
FIG. 9 is a side view showing the terminal fittings in a state where the shaft and the tubular portion are fit to each other with axial orientations changed.

As shown in FIGS. 8 and 9, a front end part of the shaft 12 is provided with locking claws 26 for preventing detachment of the shaft 12 by locking the front or rear end of the fit tubular portion 11. As shown in FIG. 2, one locking claw 26 is provided on each of open end edges at the lower end of the shaft 12. Two locking claws 26 are bent down from the open end edges of the shaft 12 to be substantially perpendicular to the bottom wall 15.

Figure 7:
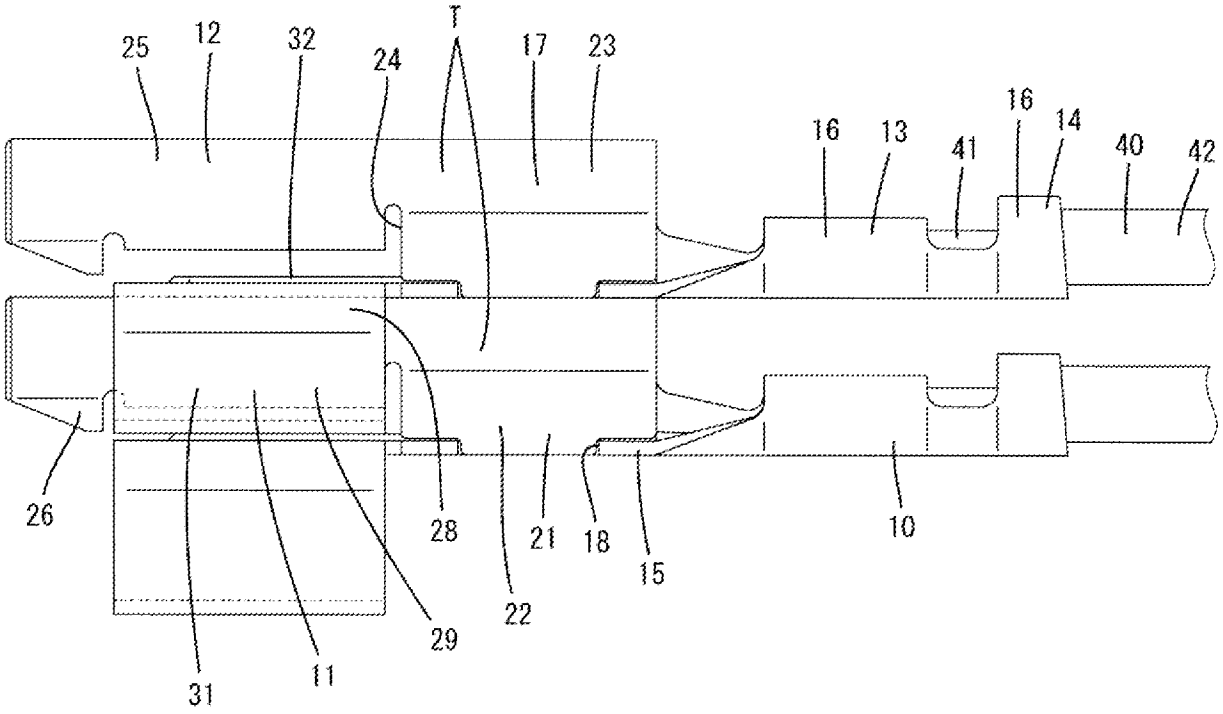
FIG. 7 is a side view showing the terminal fittings in a state where a shaft and a tubular portion are fit to each other.

As shown in FIG. 7, the locking claw 26 has a trapezoidal shape in a side view and the rear edge thereof is substantially perpendicular to the front-rear direction. Further, the front edge of the locking claw 26 is inclined to gradually increase a projecting distance from the front end toward a rear side and guides the fitting of the shaft 12 into the tubular portion 11.

As shown in FIG. 2, the tubular portion 11 has a cross-sectional shape one size larger than the shaft 12 and is open both forward and rearward. The tubular portion 11 is bent down from an edge on a side of the bottom wall 15 opposite to the side connected to the base 17 and reaches the other edge, thereby being formed into a tubular shape closed over the entire periphery. Similar to the base 17, a projecting step 21 is provided on an end edge of the tubular portion 11 and is to be fit into a recess 18 formed by recessing the side edge of the bottom wall 15 (see FIG. 9). Note that a dimension in the front-rear direction of the tubular portion 11 is equal to that of the base 17.

As shown in FIG. 2, the tubular portion 11 includes a pair of lower side walls 28 inclined slightly out toward a lower side from both side edges of the bottom wall 15 and a lower wall 29 having an arcuate shape and connected to the lower ends of the lower side walls 28. The lower wall 29 has a tube-side arcuate portion 31 formed in the tubular portion 11. The tube-side arcuate portion 31 has an arcuate shape with a larger diameter than the shaft-side arcuate portion 25.

Figure 6:
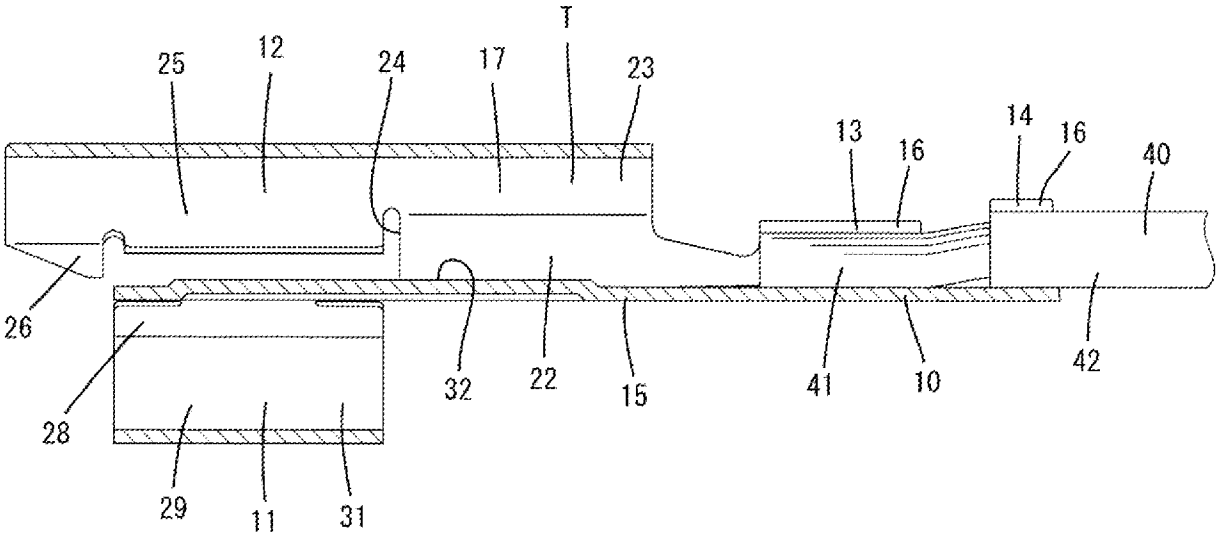
FIG. 6 is a section showing the terminal fitting in the state connected to the end part of the wire.

A step 32 projects up in a widthwise central part of the bottom wall 15. As shown in FIG. 6, the step 32 extends long and narrow in the front-rear direction from a position of the bottom wall 15 near the rear end of the base 17 to a position of the bottom wall 15 near the front end of the tubular portion 11. The step portion 32 bulges out toward the upper surface side of the bottom wall 15 and a recess is formed on the lower surface side. In a state where the shaft 12 of another terminal fitting T is fit to the tubular portion 11 of one terminal fitting T, the lower end of the tubular portion 11 of the one terminal fitting T is in contact with the step 32 of the other terminal fitting T, as shown in FIG. 8.

Next, an example of an operation of connecting a plurality of wires 40 using the aforementioned terminal fittings T is described.

First, the terminal fitting T is connected to the end part of each wire 40. The insulation coating 42 at the front part of the wire 40 is stripped to expose the core 41, and the terminal fitting T is crimped to the wire 40 by crimping the wire barrel 13 to the core 41 and crimping the insulation barrel 14 to the insulation coating 42.

Subsequently, plural terminal fittings T are held in contact. The shaft 12 of a first terminal fitting T is fit into the tubular portion 11 of a second terminal fitting T. At this time, as shown in FIGS. 7 and 8, the terminal fittings T are fit with the front-rear directions thereof oriented in the same direction if the wires 40 collectively extend in one direction from the terminal fittings T.

Specifically, the tubular portion 11 of the one terminal fitting T is located in front of the shaft 12 of the other terminal fitting T and the one terminal fitting T is pulled rearward. Then, the tubular portion 11 comes into contact with the front edges of the locking claws 26 of the shaft 12, smoothly moves over the locking claws 26 by the inclination of the front edges and is fit externally on the shaft 12. In this state, forward detachment of the tubular portion 11 is restricted by locking the front end of the tubular portion 11 by the locking claws 26 and rearward detachment of the tubular portion 11 is prevented by the upper side walls 22 of the base 17.

Further, if the wires 40 extend in directions different by 180°, as shown in FIG. 9, the front-rear directions of the terminal fittings T are opposite to each other and the shaft 12 and the tubular portion 11 are fit to each other. Specifically, the shaft 12 of another terminal fitting T oriented in the opposite direction is fit into the tubular portion 11 of one terminal fitting T. Then, rearward detachment of the tubular portion 11 is restricted by locking the rear end of the tubular portion 11 by the locking claws 26 and forward detachment of the tubular portion 11 is prevented by the upper side walls 22 of the base 17.

By successively fitting the shafts 12 and the tubular portions 11 and holding a plurality of terminal fittings T in contact in this way, the operation of connecting the plurality of wires 40 is completed.

Figure 10:
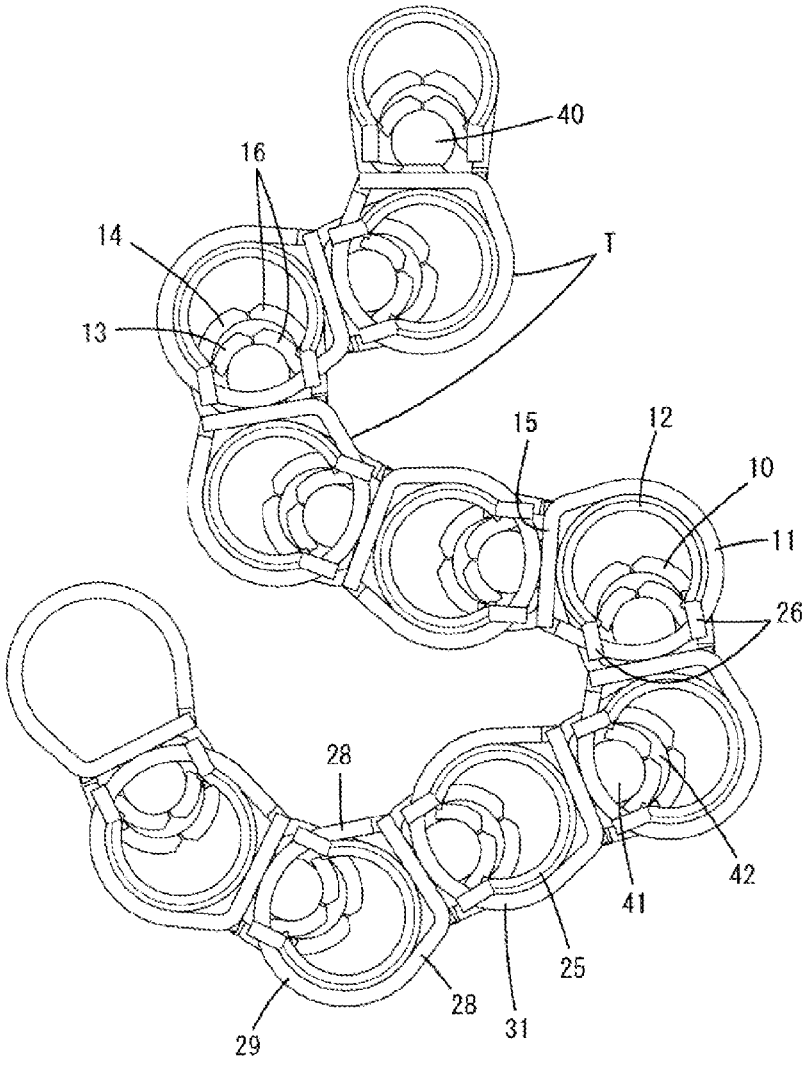
FIG. 10 is a front view showing a state of flexibly changing an arrangement shape of a plurality of terminal fittings.

With the shafts 12 and the tubular portions 11 fit to each other, the shafts 12 and the tubular portions 11 are held in contact substantially without any clearance and restrict rattling in an in-out direction (direction substantially perpendicular to the axial direction) as shown in FIG. 10. The shaft 12 is held in contact with a center of the tubular portion 11 in the width direction (lateral direction) of the bottom wall 15 and a part thereof arranged along the inner peripheral surface of the tube-side arcuate portion 31 is in surface contact. Rotational movements of the shaft 12 and the tubular portion 11 about axes are allowed by the shaft-side arcuate portion 25 and the tube-side arcuate portion 31.

Figure 11:
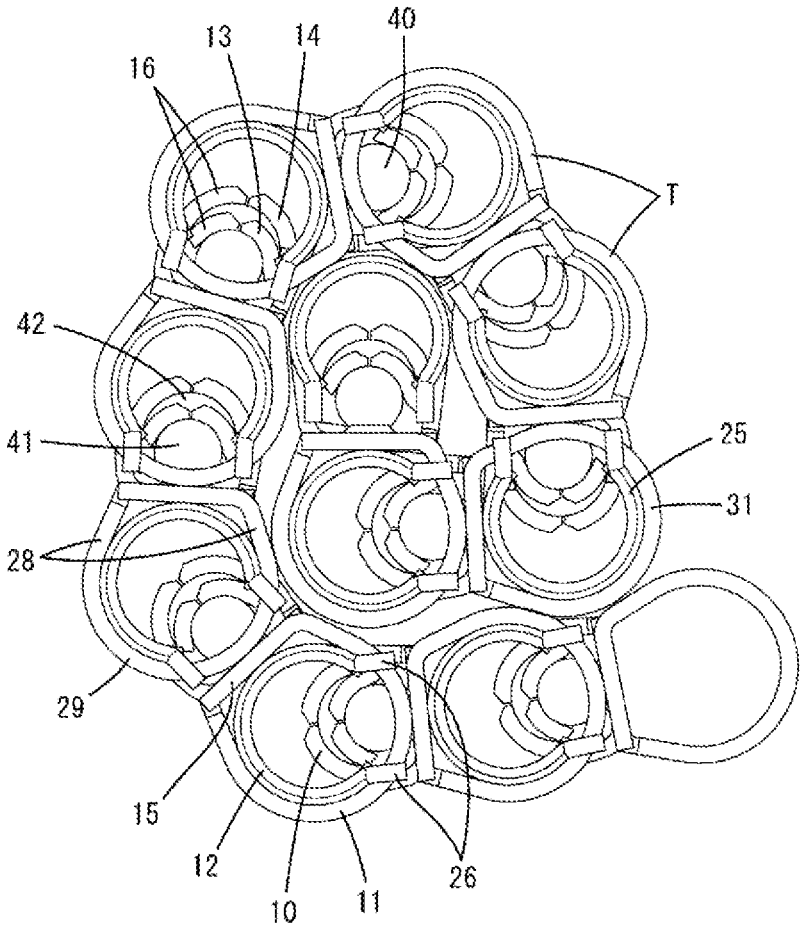
FIG. 11 is a front view showing a state where the terminal fittings are put together.
Figure 12:
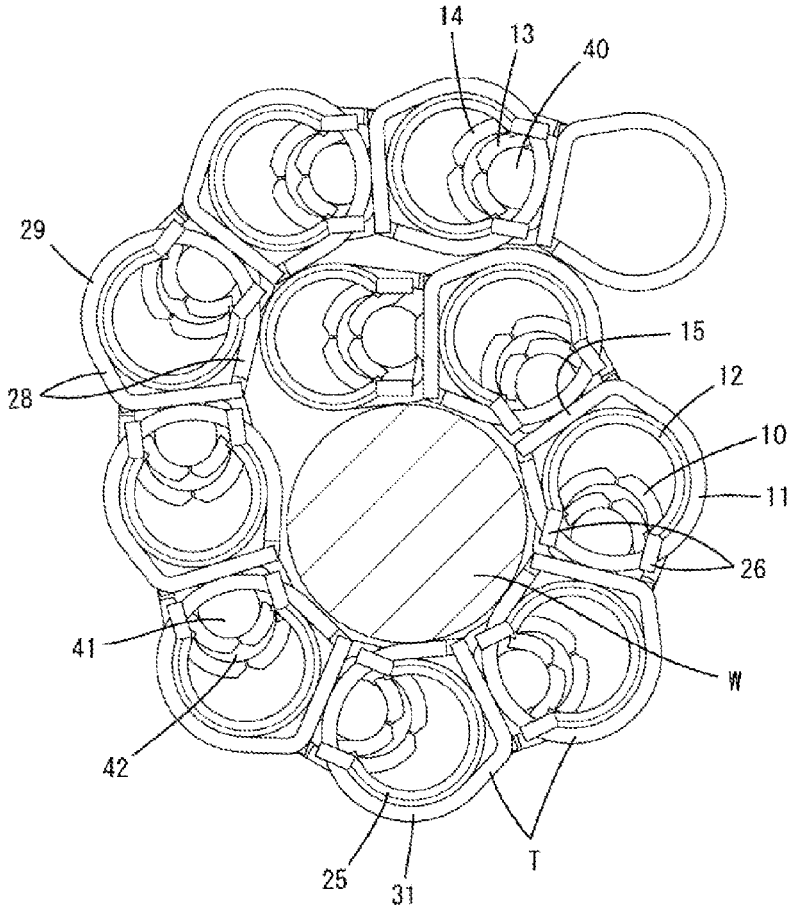
FIG. 12 is a front view showing a state where the terminal fittings are wound around the outer periphery of a wiring harness.
Figure 13:
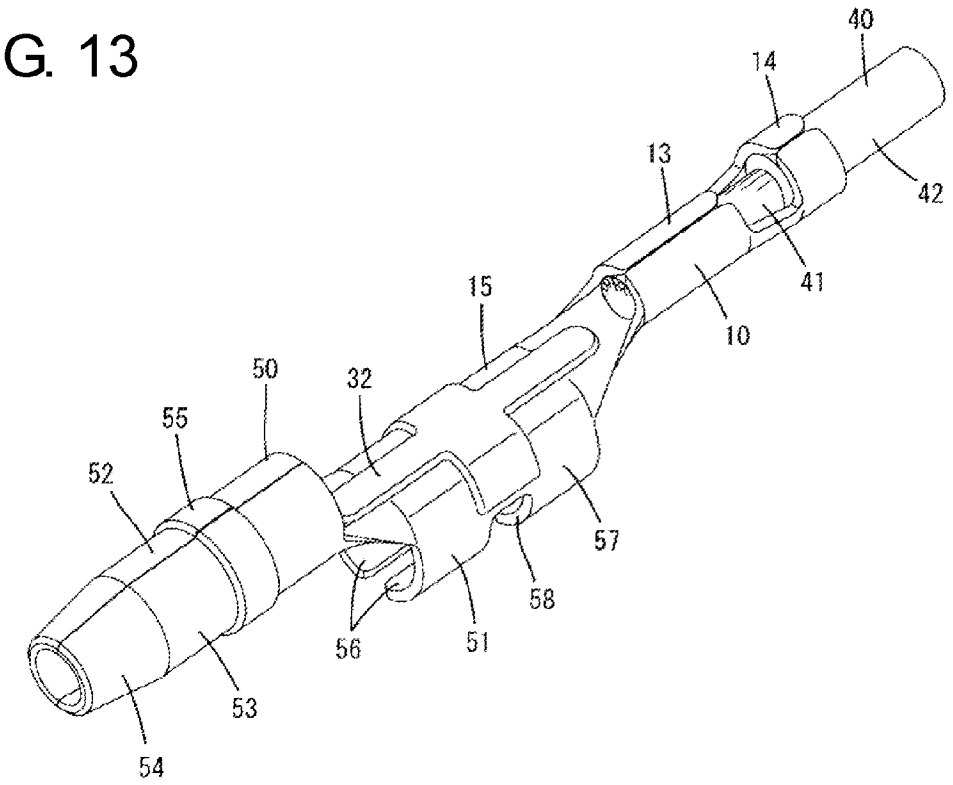
FIG. 13 is a perspective view showing a terminal fitting in a second embodiment in a state connected to an end part of a wire.
Figure 14:
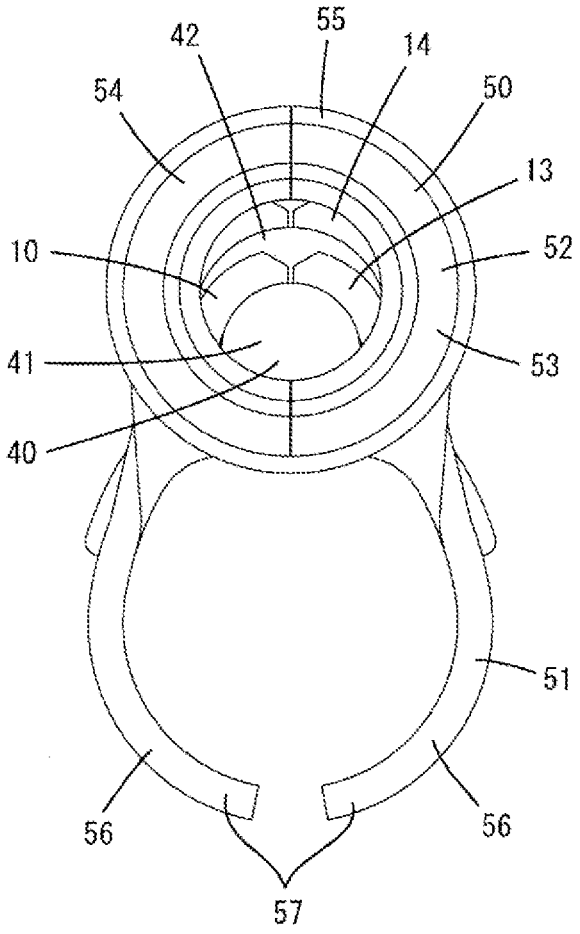
FIG. 14 is a front view showing the terminal fitting in the state connected to the end part of the wire.
Figure 15:
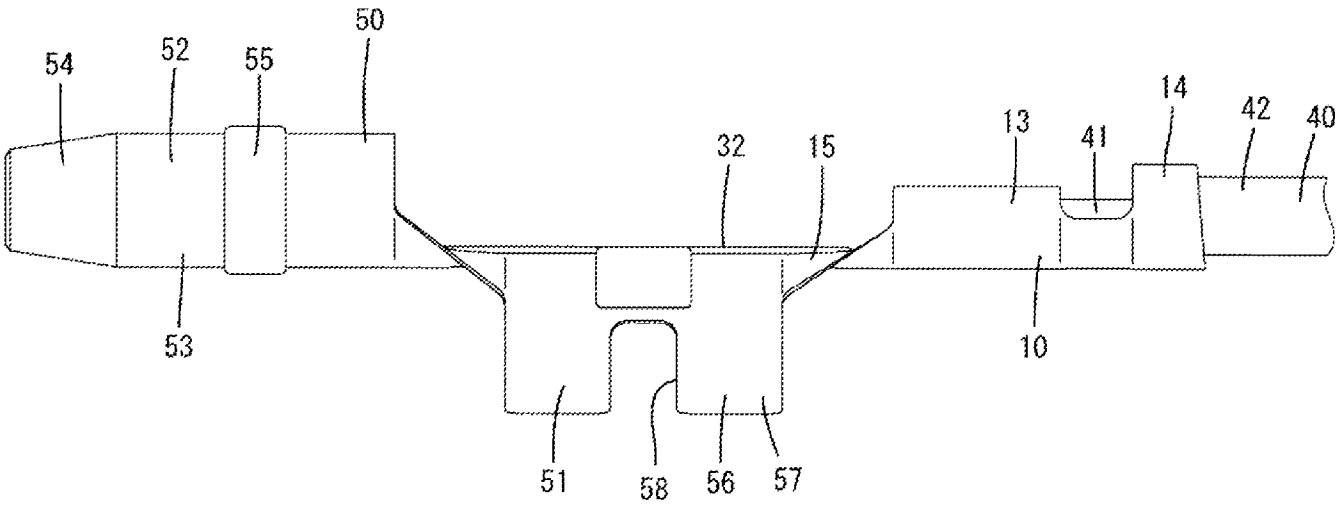
FIG. 15 is a side view showing the terminal fitting in the state connected to the end part of the wire.
Figure 16:
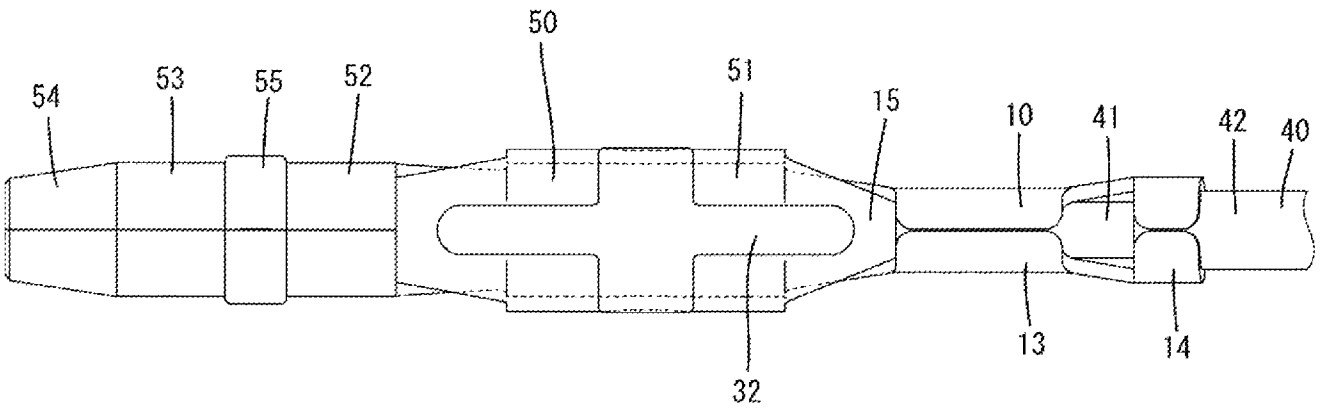
FIG. 16 is a plan view showing the terminal fitting in the state connected to the end part of the wire.
Figure 17:
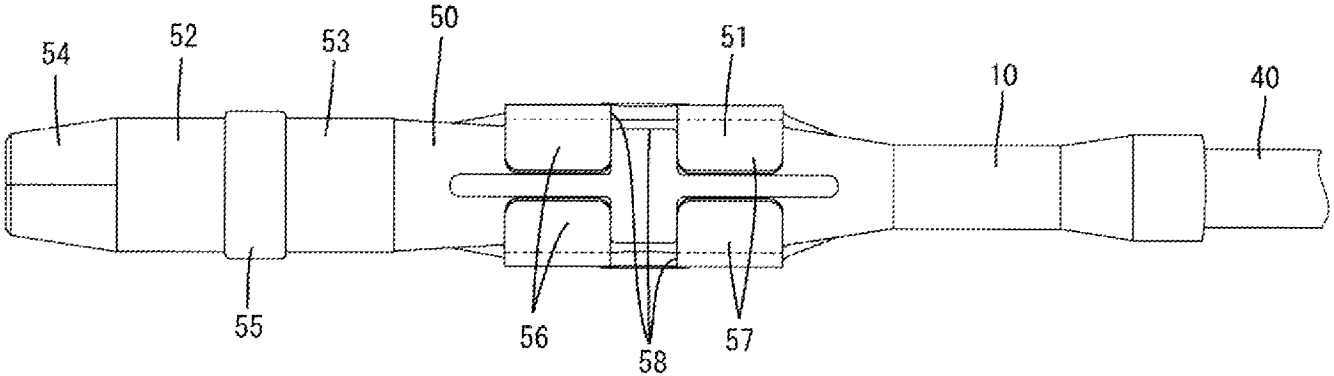
FIG. 17 is a bottom view showing the terminal fitting in the state connected to the end part of the wire.
Figure 18:
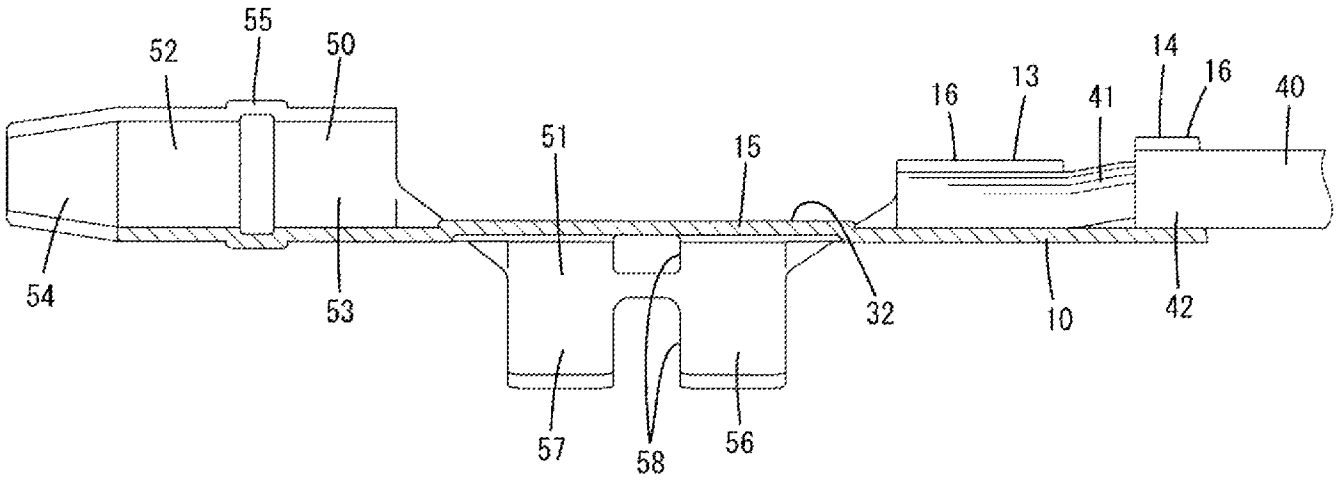
FIG. 18 is a section showing the terminal fitting in the state connected to the end part of the wire.

The terminal fittings T held in contact are unfolded, put together or wound around a wiring harness W according to a wiring space as shown in FIGS. 10, 11 and 12. An arrangement direction is deformed through relative rotation of the tubular portions 11 and shafts 12 fit to each other. Another terminal fitting T can be rotated at least by 180° with respect to one terminal fitting T. Note that the plurality of terminal fittings T formed into a predetermined arrangement shape are insulated and protected by taping or the like performed on an outer peripheral side thereof.

Next, functions and effects of the embodiment configured as described above are described.

The terminal fitting T of this embodiment is configured to connect a plurality of wires 40 by a plurality of terminal fittings T being connected to the end parts of the wires 40 and held in contact. The terminal fitting T includes the wire connecting portion 10 to be connected to the end part of the wire 40, the tubular portion 11 having a tubular shape and the shaft 12 fittable inside the tubular portion 11. The terminal fittings T are held in contact by fitting the tubular portions 11 and the shafts 12 to each other. The tubular portion 11 and the shaft 12 are provided with the shaft-side arcuate portion 25 and the tube-side arcuate portion 31 configured to enable the rotation of the tubular portion 11 and the shaft-shaped portion 12 fit to each other about the respective axes. According to this configuration, since each of the terminal fittings T held in contact can rotate about an axis in a fitting part, the arrangement shape of the plurality of terminal fittings T can be changed flexibly.

The tubular portion 11 and the shaft 12 are fittable to each other with axial orientations changed. According to this configuration, wiring directions of the wires 40 can be selected by fitting the tubular portions 11 and the shafts 12 to each other with the orientations of the terminal fitting T changed.

Further, the tubular portion 11 and the shaft 12 are provided side by side in the direction substantially perpendicular to the axial direction. According to this configuration, the terminal fittings T are arranged side by side in the direction substantially perpendicular to the axial direction if the tubular portions 11 and the shafts 12 are fit to each other. Thus, the positions of the terminal fittings T can be aligned in the axial direction.

Next, a terminal fitting 50 according to a second specific embodiment of the present invention is described with reference to FIGS. 13 to 23.

The terminal fitting 50 of this embodiment differs from the first embodiment in that a tubular portion 51 and a shaft 52 are displaced in an axial direction (front-rear direction). Note that components similar to those of the first embodiment are denoted by the same reference signs and not described.

As in the first embodiment, the terminal fitting 10 according to this embodiment is configured to connect a plurality of wires 40 by a plurality of terminal fittings T being connected to end parts of the wires 40 and held in contact, and includes a wire connecting portion 10 to be connected to the end part of the wire 40, a tubular portion 51 having a tubular shape and a shaft 52 fittable inside the tubular portion 51. Plural terminal fittings T are held in contact by fitting the tubular portions 51 and the shafts 52 to each other.

As in the first embodiment, the terminal fitting 50 is long and narrow in the front-rear direction and the wire connecting portion 10, the tubular portion 51 and the shaft 52 are formed integrally by a bottom wall 15 extending long and narrow in the front-rear direction.

The shaft 52 is provided at a front end part of the terminal fitting 50 and has a tubular shape on an upper surface side of the bottom wall 15. The shaft 52 is composed of pieces bent up from both left and right side edges of the bottom wall 15, and the tips of the pieces are butted against each other substantially in a widthwise center so that the shaft 52 is closed over the entire periphery. The shaft 52 is formed such that the entirety thereof including the bottom wall 15 has a substantially circular cross-section to define a shaft-side arcuate portion 53.

A tapered portion 54 inclined to taper the shaft 52 is formed at a front end part of the shaft 52. Further, a shaft-side lock 55 for restricting separation in the front-rear direction by being locked to a tube-side lock 58 provided in the tubular portion 51 is provided in an intermediate part of the shaft 52 in the front-rear direction. The shaft-side lock 55 is a protrusion projecting more outward than other parts, and continuously formed over the entire periphery of the shaft 52 (including the bottom wall 15). Note that a recess is formed inside the shaft-side lock 55.

The tubular portion 51 is provided between the shaft 52 and the wire connecting portion 10, has a tubular shape one size larger than the shaft 52 and is formed on a lower surface side of the bottom wall 15. The tubular portion 51 includes two side walls 56 hanging down from the both left and right side edges of the bottom wall 15 and a space between the side walls 56 is open downward. The side walls 56 of the tubular portion 51 have an arcuate shape and constitute a tube-side arcuate portion 57. The tube-side arcuate portion 57 has an arcuate shape with a larger radius than the shaft-side arcuate portion 53. A dimension in the front-rear direction of the tubular portion 51 is equal to that of the shaft 52 excluding the tapered portion 54.

The tube-side locking portion 58 is provided in an intermediate part of the tubular portion 51 in the front-rear direction and restricts separation in the front-rear direction by being locked to the shaft-side locking portion 55 on the shaft 52. The tube-side locking portion 58 is a recess having such a width (dimension in the front-rear direction) that the shaft-side locking portion 55 is fittable therein, and is formed to extend in a circumferential direction in the side walls 56 and the bottom wall 15. The tube-side locking portion 58 and the shaft-side locking portion 55 are kept locked even if the shaft 52 and the tubular portion 51 rotate.

Parts of the tube-side locking portion 58 formed in the side walls 56 are downward openings that reach the lower ends of the respective side walls 56. Further, a part of the tube-side locking portion 58 formed in the bottom wall 15 is a recess closed on an upper surface side and formed to extend in a lateral direction of the bottom wall 15. Note that a step 32 extending long and narrow in the front-rear direction is provided substantially in a center of the bottom wall 15 in the lateral direction, as in the first embodiment.

To connect the plurality of wires 40 using the aforementioned terminal fittings 50, each terminal fitting 50 is connected to the end part of each wire 40 and, subsequently, the plural terminal fittings 50 are held in contact as in the first embodiment.

Figure 19:
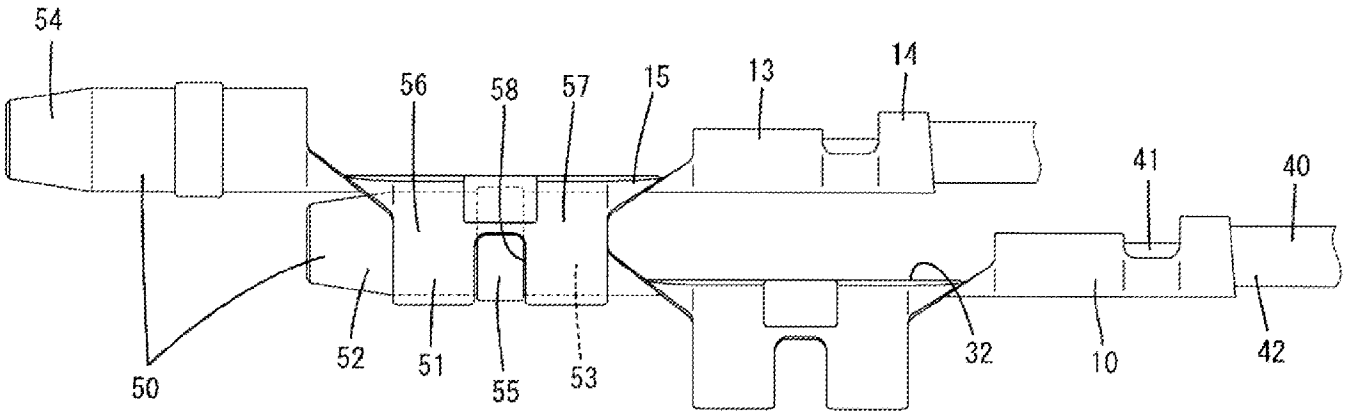
FIG. 19 is a side view showing the terminal fittings in a state where a shaft and a tubular portion are fit to each other.
Figure 20:
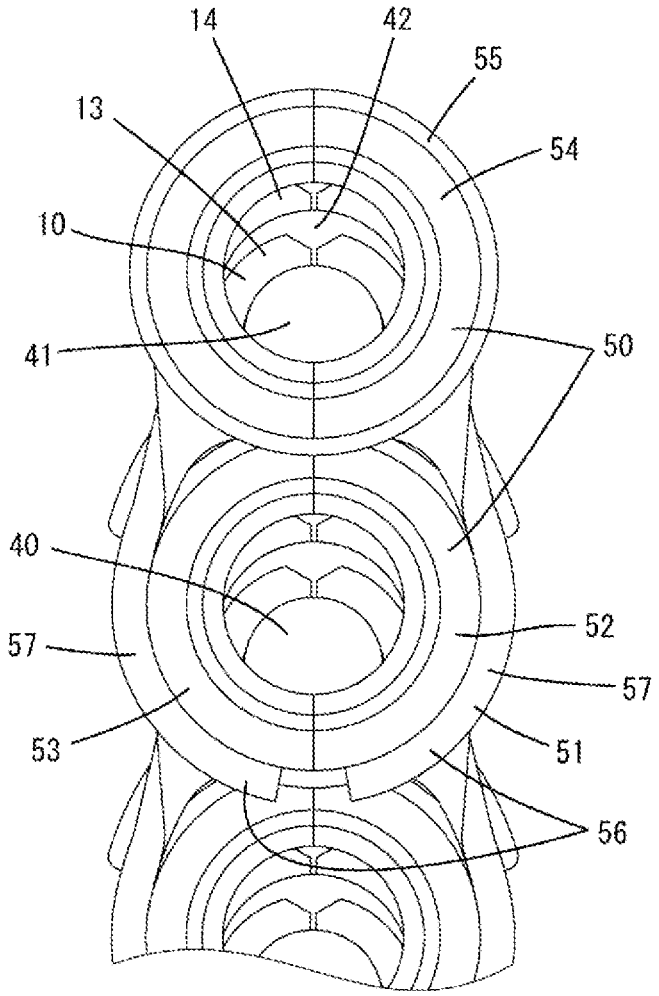
FIG. 20 is a front view showing the terminal fittings in the state where the shaft and the tubular portion are fit to each other.
Figure 21:
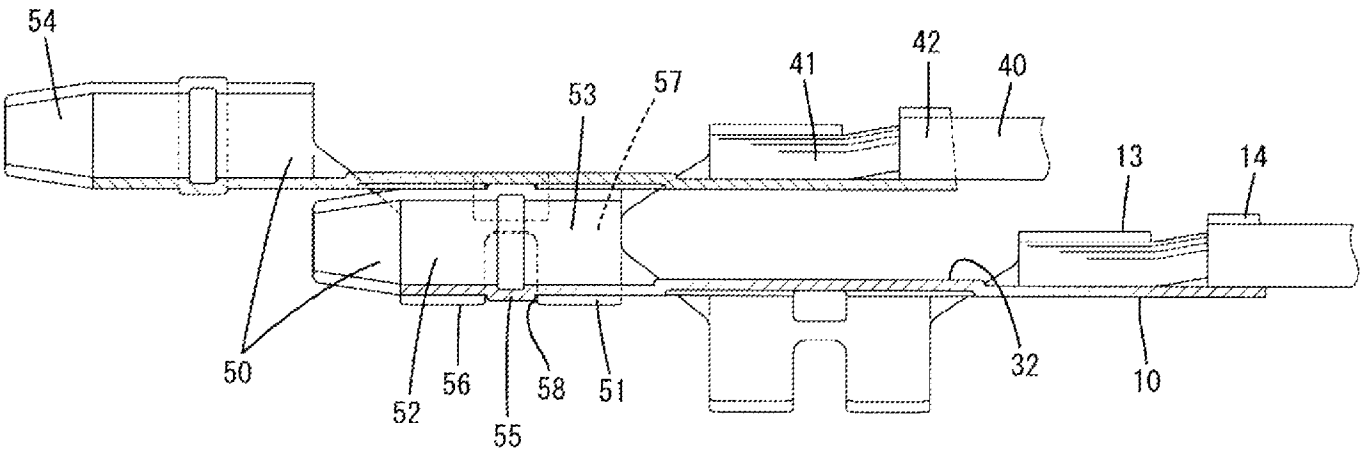
FIG. 21 is a section showing the terminal fittings in the state where the shaft and the tubular portion are fit to each other.

If the wires 40 collectively extend in one direction from the terminal fittings 50, as shown in FIGS. 19 and 21, the tubular portion 51 and the shaft 52 are fit to each other with the front-rear directions of the terminal fittings 50 oriented in the same direction as in the first embodiment. Specifically, as in the first embodiment, the tubular portion 51 of one terminal fitting 50 is located in front of the shaft 52 of the other terminal fitting 50 and the one terminal fitting 50 is pulled rearward. Then, the side walls 56 of the tubular portion 51 are deformed resiliently slightly out to move over the shaft-side locking portion 55 of the shaft 52 so that the tubular portion 51 and the shaft 52 are fit to each other. In this state, the shaft-side locking portion 55 and the tube-side locking portion 58 come into contact in the front-rear direction, thereby restricting the separation of the tubular portion 51 and the shaft 52. The shaft 52 and the tubular portion 52 fit to each other are in contact substantially without any clearance to restrict rattling in an in-out direction (direction substantially perpendicular to the axial direction), as shown in FIG. 20 and as in the first embodiment. The shaft 52 is in surface contact with the substantially entire inner peripheral surfaces of the side walls 56 (tube-side arcuate portion 57) of the tubular portion 51. Rotational movements of the shaft 52 and the tubular portion 51 about axes are allowed by the shaft-side arcuate portion 53 and the tube-side arcuate portion 57.

Figure 22:
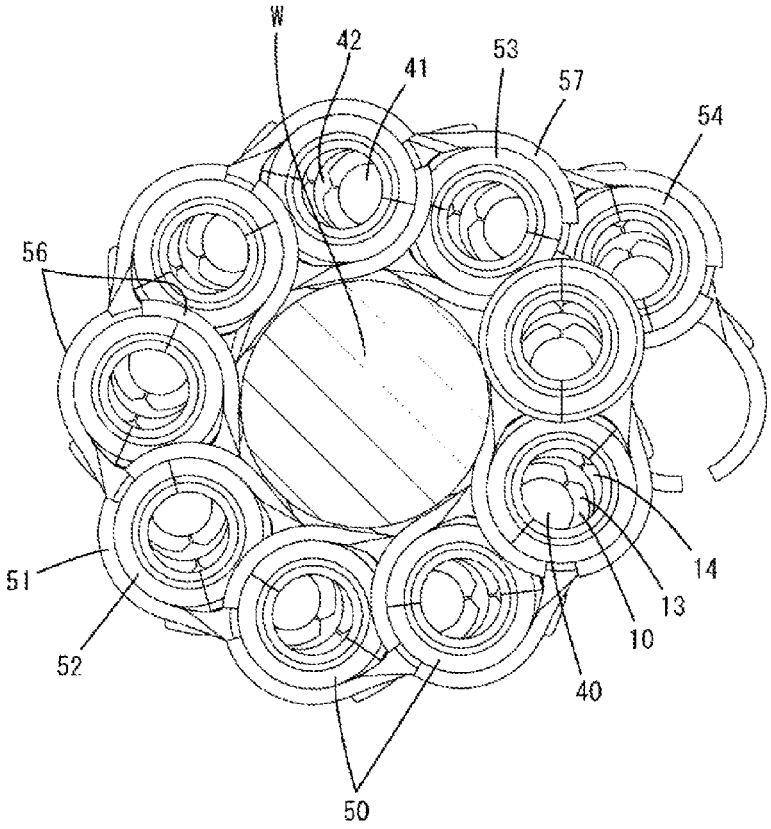
FIG. 22 is a front view showing a state where a plurality of terminal fittings are wound around the outer periphery of a wiring harness.

Plural of terminal fittings 50 held in contact by successively fitting the shafts 52 and the tubular portions 51 to each other are displaced rearwardly little by little (by the length of the shaft 52). Thus, for example, in the case of winding the plurality of terminal fittings 50 around a wiring harness W, the terminal fittings 50 are displaced axially and spirally wound in one layer without being doubly or triply overlapped on the outer periphery of the wiring harness W, as shown in FIG. 22.

Figure 23:
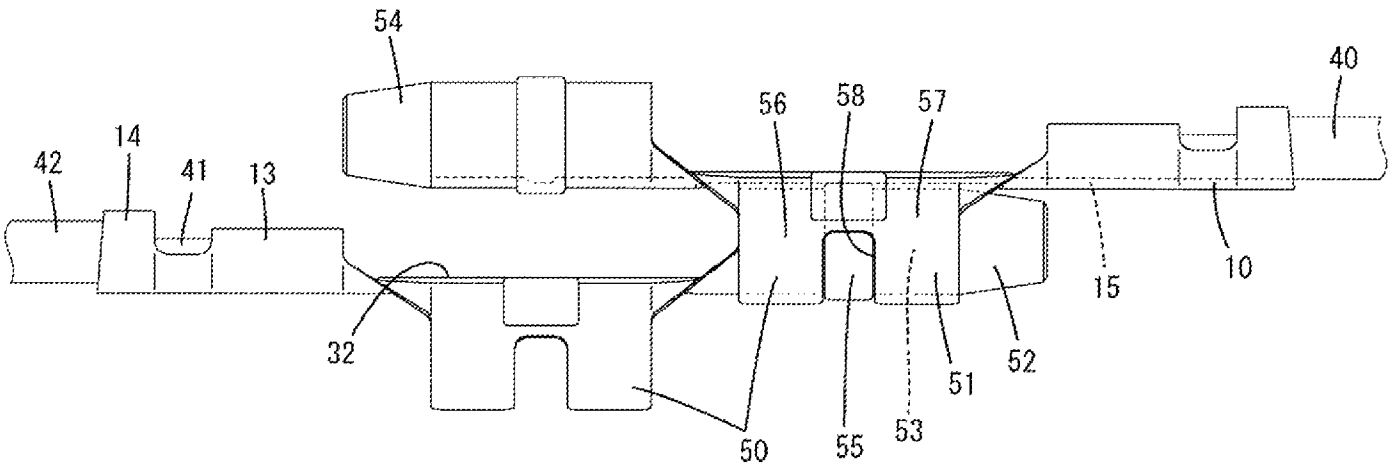
FIG. 23 is a side view showing the terminal fittings in a state where the shaft and the tubular portion are fit to each other with axial orientations changed.

Note that, if wires 40 extend in directions different by 180°, as shown in FIG. 23, the front-rear directions of the terminal fittings T are made opposite to each other and the shaft 52 and the tubular portion 51 are fit to each other as in the first embodiment. Specifically, the shaft 52 of another terminal fitting T oriented in the opposite direction is fit into the tubular portion 51 of one terminal fitting T and the shaft-side locking portion 55 and the tube-side locking portion 58 are locked.

As described above, in this embodiment, the tubular portion 51 and the shaft 52 are provided with the tube-side arcuate portion 57 and the shaft-side arcuate portion 53 configured to enable the rotation of the tubular portion 51 and the shaft 52 fit to each other about the respective axes. Thus, as in the first embodiment, the arrangement shape of the terminal fittings 50 can be changed.

In addition, since the tubular portion 51 and the shaft 52 are displaced in the axial direction, a plurality of terminal fittings 50 held in contact can be spirally wound and, hence, a diameter in a front view can be reduced. Further, since each of the shaft 52 and the tubular portion 51 is formed by being bent up or down from the bottom wall portion 15, easy manufacturing is possible and yield is good.

The invention is not limited to the above described and illustrated embodiments. For example, the following embodiments also are included in the scope of the invention.

Although the shaft 12, 52 is provided with the shaft-side arcuate portion 25, 53 and the tubular portion 11, 51 is provided with the tube-side arcuate portion 31, 57 in the above embodiments, there is no limitation to this and only either the tubular portion or the shaft may be provided with an arcuate portion. For example, one arcuate portion may have a cylindrical shape and the other may have a polygonal shape or the like.

Although the shaft 12, 52 and the tubular portion 11, 51 are fit in the front-rear direction (axial direction) in the above embodiments, there is no limitation to this. For example, the shaft and the tubular portion may be fit in the lateral direction (direction substantially perpendicular to the axial direction). For example, after the laterally open tubular portion is resiliently expanded by having the shaft laterally fit therein, the tubular portion may be resiliently restored in a closing direction to fit the tubular portion and the shaft to each other.

LIST OF REFERENCE SIGNS

T, 50 . . . terminal fitting
10 . . . wire connecting portion
11, 51 . . . tubular portion
12, 52 . . . shaft
25, 53 . . . shaft-side arcuate portion
31, 57 . . . tube-side arcuate portion
40 . . . wire

The invention claimed is:

1. A terminal fitting for connecting a plurality of wires by a plurality of terminal fittings being connected to end parts of the wires and held in contact, comprising:

a wire connecting portion to be connected to the end part of the wire;

a tubular portion having a tubular shape, provided on one surface side of a bottom wall extending in one direction and formed to be open on both sides in an axial direction; and a shaft provided on the other surface side of the bottom wall and fittable inside a tubular portion of another terminal fitting;

wherein:

the terminal fittings are held in contact by fitting the tubular portion of the other terminal fitting and the shaft to each other;

the tubular portion of the other terminal fitting and the shaft are fittable to each other regardless of whether axial orientations of the terminal fittings are the same or opposite; and the tubular portion or the shaft is provided with an arcuate portion configured to enable the rotation of each of the tubular portion and the shaft about an axis in a state where the tubular portion and the shaft are fit to each other.

2. A terminal fitting according to claim 1, wherein the tubular portion and the shaft are displaced in an axial direction.

* * * * *